US005385376A

United States Patent [19]

Malaspina et al.

[11] Patent Number: 5,385,376

[45] Date of Patent: Jan. 31, 1995

[54] DEVICE FOR PICKING UP LITTER SUCH AS ANIMAL EXCREMENT

[75] Inventors: Giorgio Malaspina, Ovada, Italy; Nicola Francone, Yerres, France

[73] Assignees: Socoplast, France; Nuova Poliver Di Oddone C., Italy

[21] Appl. No.: 165,963

[22] Filed: Dec. 10, 1993

[30] Foreign Application Priority Data

Dec. 15, 1992 [FR] France ..... 92 15107
Jul. 9, 1993 [FR] France ..... 93 08480

[51] Int. Cl.[6] ..... A01K 29/00; E01H 1/12
[52] U.S. Cl. ..... 294/1.3; 15/257.6
[58] Field of Search ..... 294/1.3–1.5, 294/25, 55; 15/104.8, 257.1, 257.4, 257.6, 267.9

[56] References Cited

U.S. PATENT DOCUMENTS

| | | | |
|---|---|---|---|
| 3,703,158 | 11/1972 | Lemler | 294/1.3 |
| 3,767,247 | 10/1973 | Wetzler | 294/1.3 |
| 4,010,970 | 3/1977 | Campbell | 294/1.5 |
| 4,154,389 | 5/1979 | Dell'Anno | 294/1.3 |
| 4,215,887 | 8/1980 | Boots | 294/1.4 |
| 4,875,729 | 10/1989 | Peck | 294/1.3 |

FOREIGN PATENT DOCUMENTS

| | | | |
|---|---|---|---|
| 1001377A3 | 10/1989 | Belgium . | |
| 2505898 | 11/1982 | France . | |
| 2645188 | 10/1990 | France | 294/1.3 |
| 3909418 | 11/1989 | Germany | 294/1.3 |
| 8802356 | 4/1990 | Netherlands | 294/1.3 |
| 651873 | 10/1985 | Switzerland | 294/1.3 |
| 2034234 | 6/1980 | United Kingdom | 294/1.3 |
| 2227645 | 8/1990 | United Kingdom | 294/1.3 |

*Primary Examiner*—Johnny D. Cherry
*Attorney, Agent, or Firm*—Graham & James

[57] ABSTRACT

The invention relates to a device for picking up litter, in particular animal excrement. It comprises both a set of tongs having two arm-forming assemblies that are hinged to each other at their ends about an axis, each arm-forming assembly being extended beyond the axis by a control extension, a second end of each arm-forming assembly including a terminal portion, actuating the control extensions causing the terminal portions to move apart, and a bag having a bottom-forming portion disposed between the arm-forming portions, the remainder of the bag being folded around the terminal portions, the folded portion clinging to the terminal portions and/or the arm-forming assemblies.

17 Claims, 4 Drawing Sheets

DEVICE FOR PICKING UP LITTER SUCH AS ANIMAL EXCREMENT

The present invention relates to a device for backing up litter, in particular animal excrement, by using a disposable bag.

BACKGROUND OF THE INVENTION

More precisely, the present invention relates to a pick-up device that uses a bag enabling litter, and in particular dog excrement, to be picked up from a sidewalk under conditions of improved hygiene and convenience.

Belgian patent No. 1 001 377 describes hand-held tongs for picking up dog excrement. That invention consists in the combination of a tong-forming assembly and a bag. The tong-forming assembly is inserted into the bag and, after the free ends of the tongs have been moved apart, an outwardly open cavity is formed in the bottom of the bag by pushing in the bottom of the bag by hand. To use that assembly, the edges of the cavity defined by the ends of the tongs are placed on either side of the object to be picked up and said ends are caused to move towards each other, thereby simultaneously grasping the object inside the cavity. The object can then be enclosed and the tongs released merely by turning the bag inside out. Nevertheless, the tongs are awkward to use and there is no guarantee that the bag will stay properly in place on the tongs.

OBJECTS AND SUMMARY OF THE INVENTION

An object of the present invention is to provide a device for picking up litter that avoids any awkward handling in use, while ensuring that litter is picked up conveniently and efficiently.

To achieve this object, the present invention provides a device for picking up litter, such as animal excrement, and comprising a tongs device and a bag suitable for mounting on said tongs device, wherein said tongs device comprises: two arm-forming assemblies that are hinged to each other at first ends about an axis, each arm-forming assembly being extended beyond said axis by a control extension, the second end of each arm-forming assembly including a terminal portion extending parallel to said axis; and return means tending to press said terminal portions against each other, and wherein the bag comprises a pocket-forming portion including two facing walls that are interconnected by means of a bottom and two bellows-forming parts, and an extension-forming portion, said pocket-forming portion being designed to be disposed between the arm-forming assemblies of the tongs device, the extension-forming portion of the bag being designed to be folded back around said terminal portions, said folded-back extension extending substantially over the entire length of the arm-forming assemblies of the tongs device.

It will be understood that the assembly constituted by the picking-up device is particularly convenient to use since after the arm-forming assemblies have been splayed apart, it suffices merely to insert the first portion of the bag between said elements, to fold the remainder of the bag around each end portion, and to apply the folded-down portion of the bag against the first portion thereof to obtain temporary fixing of the bag on the pick-up tongs by semi-adhesion or "clinging". The ends of the arm-forming elements then merely need placing on either side of the litter to be picked up and the ends moved towards each other in order to insert the litter into the bag.

In a variant, it is possible to insert a portion of the tongs into the bag, to splay apart the two ends of the arms of the tongs, and then to push the bottom of the bag in between the splayed apart arms to form a cavity. The ends of the arm-forming elements can then be placed on either side of the litter to be picked up and the elements can then be moved towards each other.

In a first embodiment, the bag includes a first portion constituted by two facing walls connected together along two parallel sides by bellows-forming parts and also connected together along a bottom-forming third side, and an extension-forming second portion constituted by two extensions, each extension extending beyond the fourth side of the corresponding wall, whereby said extensions are free to be folded down over said walls about said fourth sides that coincide with respective terminal portions of the tongs device.

In a second embodiment, said extension-forming portion of the bag extends all of the walls of the pocket-forming portion of the bag, said bag being made of a material such that after the extension-forming portion of the bag has been folded around the terminal portions of the tongs device, the folded-down portion clings to said terminal portions and/or to said arm-forming assemblies.

BRIEF DESCRIPTION OF THE DRAWINGS

Other features and advantages of the present invention appear more clearly on reading the following description of various embodiments of the invention given as non-limiting examples. The description refers to the accompanying drawings, in which.

MORE DETAILED DESCRIPTION

Figure 1:
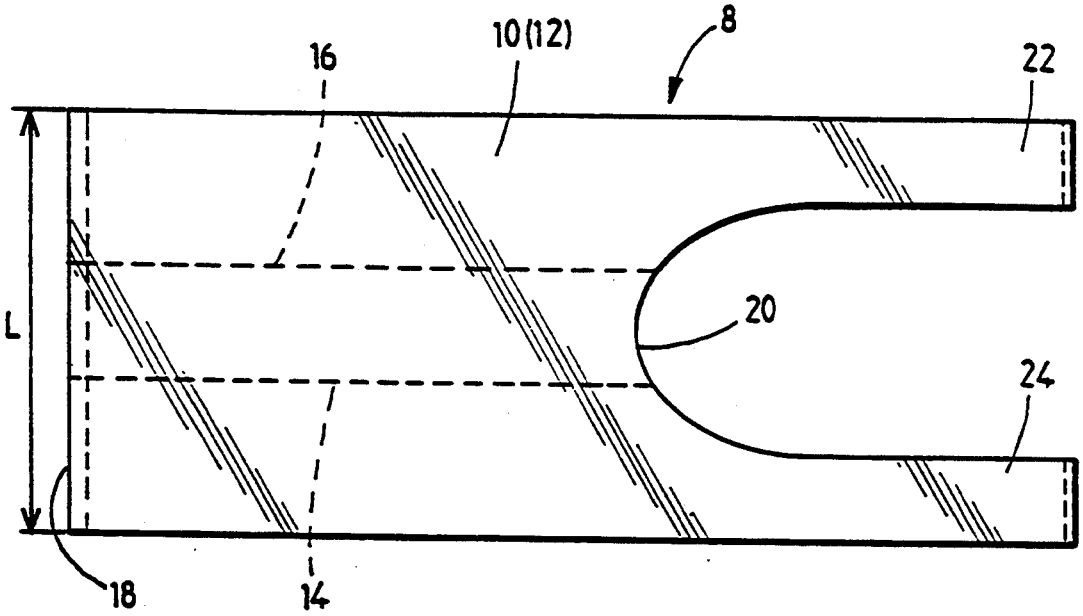
FIG. 1 is a plan view of a discardable bag in a first embodiment of the invention.

As shown in FIG. 1, the first embodiment of the discardable bag 8 suitable for use in the litter pick-up device comprises two faces, with only the face 10 being visible in FIG. 1, which faces are connected to each other by bellows 14 and 16. The bottom of the bag is closed, e.g. by thermowelding 18 which connects together the two faces 10 and 12 of the bag. At its end opposite from the bottom 18, the bag is terminated by a notch cutout 20 which thus defines two handles 22 and 24 for holding the bag after litter has been picked up and suitable for tying together to close the bag and keep the litter inside it. The bag is preferably made of a plastics material which may be a free radical low density polyethylene, a free radical high density polyethylene, a linear polyethylene, or a vinyl acetate ethylene, PVC, polypropylene, or a mixture of at least some of these materials. As can be seen in the figure, the width L of the bag is defined relative to the width L' of the tongs in a manner explained below. The plastics material is of the type that provides semi-adhesion or "clinging" when tension is exerted thereon, in particular adhesion on a portion of the tongs as explained below.

Figure 2:
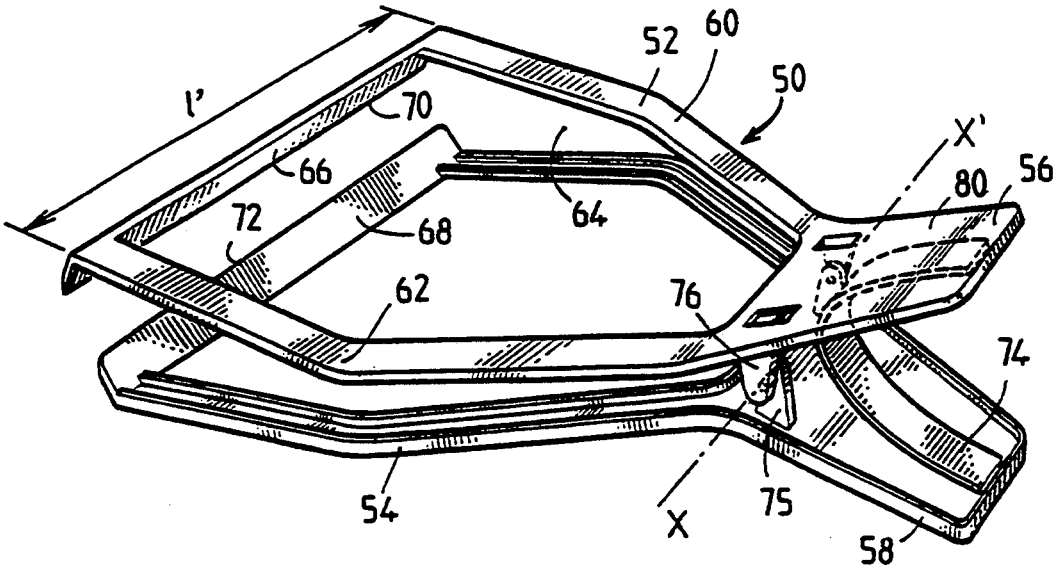
FIG. 2 is a perspective view of the tongs of a pick-up device designed to be used, in particular, with the bag of FIG. 1.

With reference to FIG. 2, there now follows a description of a preferred embodiment of the pick-up tongs using the bag 8 of FIG. 1. The pick-up device is given reference 50 and is generally in the form of a pair of tongs, being constituted by two arm-forming assemblies 52 and 54 which are hinged to each other at one of their ends about an axis XX', the arm-forming assemblies 52 and 54 being extended beyond the axis XX' by control extensions 56 and 58. Each portion 56 and 58 is preferably at an angle of about 30° relative to the arm-forming assembly 52, 54 with which it is associated, thereby enabling a gap 64 to be formed between the assemblies. Each arm-forming assembly 52 or 54 comprises a pair of arms disposed in a common plane, e.g. arms 60 and 62 for the assembly 52; the ends of the arms in each pair that are furthest from the hinge axis XX' are interconnected by respective cross-members 66 and 68, thus constituting terminal elements for each arm-forming assembly, with the cross-members 66 and 68 for each arm-forming assembly extending substantially parallel to the axis XX'. The cross-members 66 and 68 preferably include respective lip-forming portions 70 and 72, with the lips 70 and 72 facing each other.

A resilient member such as a spring blade 74 is preferably interposed between the control extensions 56 and 58, thereby tending to splay the control extensions apart and thus to cause the lips 70 and 72 of the cross-members 66 and 68 to press against each other.

The hinge XX' may be implemented by co-operation between complementary orifices and studs carried on respective tabs 76 and 75, respectively secured to the control extensions 56 and 58.

Figure 3:
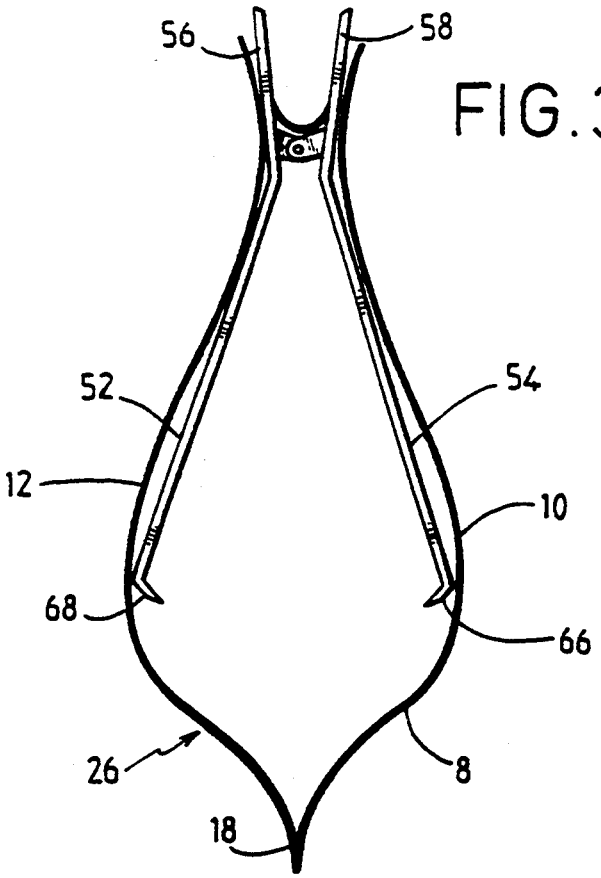
FIG. 3 is an elevation view of the assembled pick-up means constituted by the pick-up tongs and the discardable bag installed on the tongs, and showing a first way of putting the bag into place.
Figure 4:
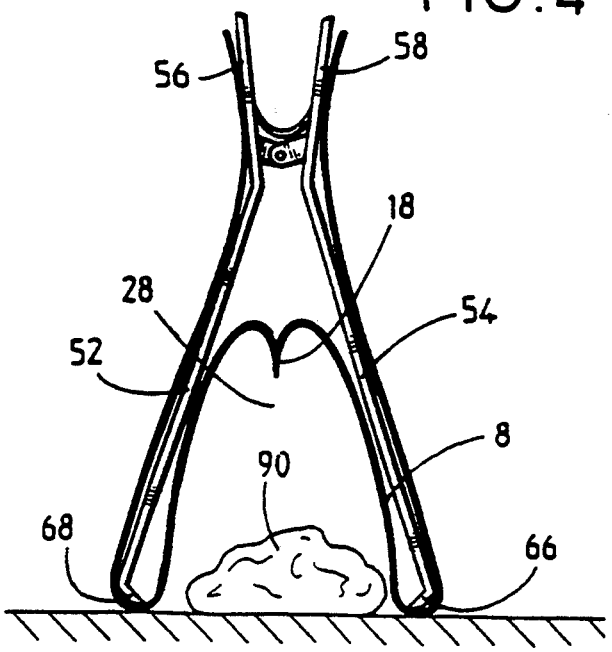
FIG. 4 is a view similar to FIG. 3 showing the pick-up device in its in-use position.

With reference now to FIGS. 3 and 4, there follows a description of a first way in which the bag 8 can be used in combination with the tongs of FIG. 2. To use the pick-up device, the arms 52 and 54 of the tongs are splayed apart and the ends of the arms are inserted into the bag 8 by spreading apart the notched ends of the faces 10 and 12 of the bag. This is as shown in FIG. 3. The tongs are inserted into the bag in such a manner as to leave a first or significant portion 26 of the bag in which the tongs are not inserted. Thereafter, the hand is used to push the bottom 18 of the bag 8 between the two ends 66 and 68 of the tongs, thereby forming a cavity 28 in the outside face of the bag. While the cavity 28 is being formed, the walls 10 and 12 of the bag are retained by the ends 66 and 68 of the tongs. This exerts a certain amount of tension on the plastics material constituting the bag, thereby causing said portion of the bag to cling to the tongs because of the nature of the plastics material used. It can be seen that the folded-back portion of the bag has a length that is substantially equal to the length of the arms of the tongs. This clinging effect is produced, in particular, between the wall of the folded-back portion of the bag and the ends 66, 68 of the arms 60 and 62 of the tongs. Once the bag has been put into place, it suffices merely to open the two arms of the tongs far enough apart to surround the litter 90 to be picked up, after which the two ends of the tongs are allowed to come back into contact with each other under drive from the return spring 74. The litter is thus enclosed in the cavity of the bag. It then suffices merely to turn the remainder of the bag inside out so as to enclose the litter, after which the handles 22 and 24 of the bag can be tied together in order to ensure that the litter 90 remains confined therein.

The length of the bag is preferably sufficient to ensure that when the tongs are inserted into the bag, the handles 22 and 24 are substantially at the same level as the control extensions 56 and 58.

Figure 5:
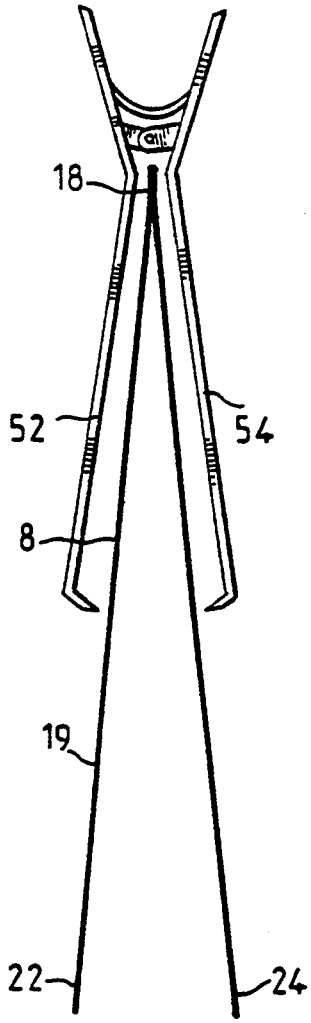
FIG. 5 is a view similar to FIG. 3 showing a second way of installing the bag on the tongs.

FIG. 5 shows a variant way in which the bag can be installed on the tongs. The arms 52 and 54 of the tongs are splayed apart and the portion of the bag 8 that includes its bottom 18 is placed between the two arms; the remainder 19 of the bag, including the closure handles 22 and 24, lies outside the tongs. Thereafter, the portion 19 of the bag is folded back over the ends 66 and 68 of the tongs so as to obtain the configuration shown in FIG. 4.

It should be observed that the lips 70 and 72 provided on the cross-members 66 and 68 perform several functions. Firstly, they act as shovels which assist in inserting the litter 90 into the bag as they move towards each other. Secondly, the presence of these lips which thus establish a generally rounded shape prevents any risk of tearing in the portion of the bag that is in contact with the ends of the arm-forming elements. Finally, when tension is exerted on the bottom of the bag to make the cavity, the material constituting the bag is caused to cling to the end portions of the tongs.

Figure 6:
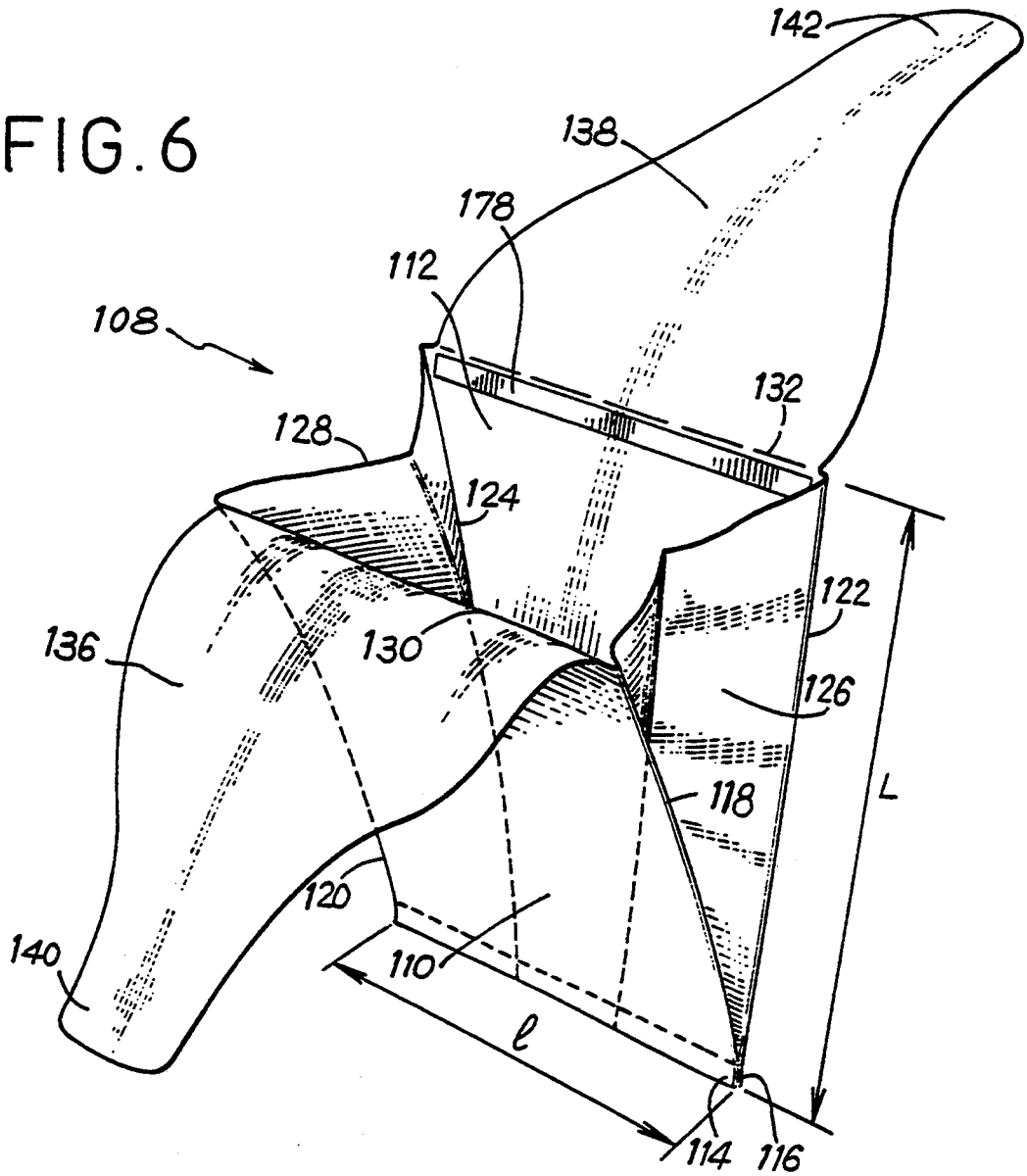
FIG. 6 is a perspective view of a second embodiment of the bag.

With reference firstly to FIG. 6, a second embodiment of the pick-up bag 108 is described. It is constituted by two facing walls 110 and 112 that are rectangular in shape, for example. Each wall 110 and 112 includes a first side respectively referenced 114 and 116. These sides 114 and 116 are welded together so as to form the bottom of a first portion of the bag. The wall 110 has sides 118 and 120 that are substantially parallel to each other and perpendicular to the side 114, and these sides 118 and 120 are respectively connected to corresponding sides 122 and 124 of the wall 116 via bellows-forming portions 126 and 128. Each wall 110 and 112 thus includes a fourth edge that remains free, said edges being respectively referenced 130 and 132. The bag further includes a second portion constituted by two extensions 136 and 138 extending the walls 110 and 112 beyond the fourth edges 130 and 132. These two extensions are free relative to each other. These extensions form integral parts of the walls. At their bases, these extensions preferably have the same width 1 as the sides 116 and 130; however, they taper in width down to respective ends referenced 140 and 142. In FIG. 6, the length L of the sides 118 and 122 of the faces of the walls in the first portion of the bag associated with the bellows 126 and 128 can be seen. It will be understood that the extensions 136 and 138 may be folded down outside the first portion of the bag against the outside faces of the walls 110 and 112. The extensions 136 and 138 are preferably of length greater than L.

The bag may advantageously be made of polyethylene.

Figure 7:
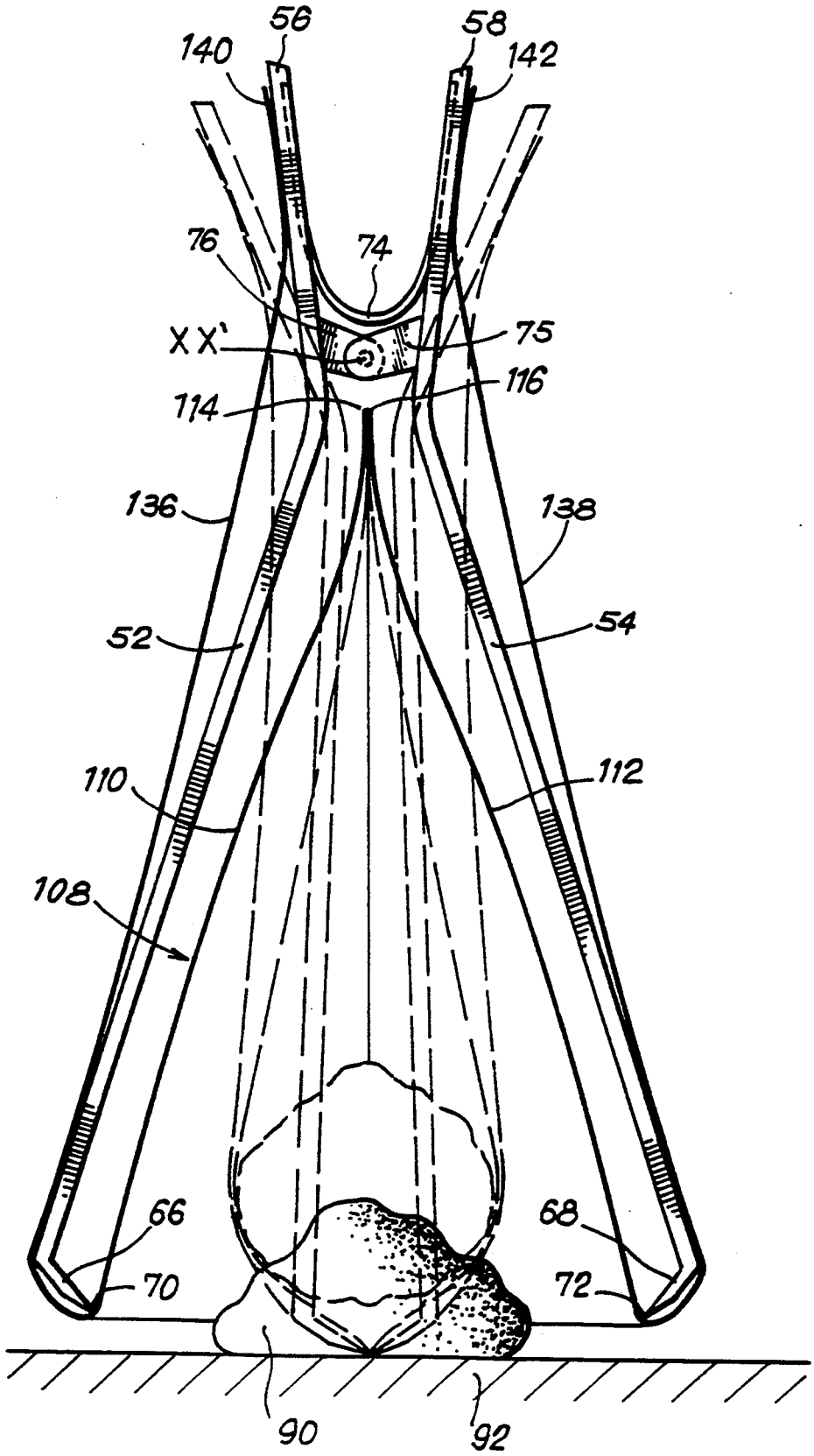
FIG. 7 is an elevation view showing the pick-up device fitted with the second embodiment of the bag.

With reference now to FIG. 7, a method of using the pick-up device together with its discardable bag is described. The bag 108 is installed between the arm-forming assemblies 52 and 54 of the pick-up device. More precisely, the first portion of the bag constituted by the walls 110 and 112 is inserted between the two arm-forming assemblies in such a manner that the bottom 114, 116 of the bag comes substantially into contact with the hinge axis XX'. Naturally, during this operation, the control extensions 56 and 58 are acted on to splay apart the arm-forming assemblies. The extensions 136 and 138 of the bag are folded around the end cross-members 66 and 68 of the arm-forming assemblies and overlie the outside faces of the walls 110 and 112. The free ends 140 and 142 of the bag 108 are preferably secured to the control extensions 56 and 58 of the pick-up device. Also preferably, the free ends 140 and 142 are fixed on respective plane portions 80 of the control extensions 56 and 58 of the pick-up device. This fixing can be obtained either by means of respective adhesive elements disposed on the outside faces of the ends 136 and 138, or else by means of respective adhesive elements disposed on the plane portions 80 of the control extensions 56 and 58. It will be understood that once the discardable bag has been fitted, the control means are easy to use. It suffices to splay apart the two arms to surround the litter 90 to be picked up where it rests on the ground 92.

Once the litter 90 has penetrated into the bag under the effect of the cross-members 66 and 68 moving towards each other, as shown in dashed lines in FIG. 7, it suffices merely to detach the ends 140 and 142 of the extensions of the bag to fold them down so as to bring them into line with the first portion of the bag. At this point the entire bag can be withdrawn from the pick-up device and can be closed by any appropriate means. These means may be constituted by a strip. 178 of adhesive material placed on the inside face of one of the walls 110, 112 close to its fourth side.

We claim:

1. A device for picking up litter such as animal excrement comprising:

a tongs device having:

two substantially identical arm forming assemblies, each of said arm forming assemblies comprising two elongated elements each having first and second ends, interconnection means for interconnecting said first ends of the elongated elements, and a cross-member for interconnecting said second ends of said elongated elements, said cross-members each comprising a lip portion, an axis disposed in parallel with said cross-members, said interconnection means disposed relative to said axis so that said arm forming assemblies pivot about said axis, two control extensions disposed opposite said axis from said arm forming assemblies, each said control extension being integral with a respective one of said arm forming assemblies and being disposed at an angle relative to the respective arm forming assembly, and resilient return means cooperating with said control extensions for pressing the lip portions of said cross-members against each other; and a bag comprising a pocket-forming portion including two facing walls interconnected at a bottom thereof, two bellows-forming parts, and an extension-forming portion having a free end, said bag being selectively mountable on the tongs device by disposing said pocket-forming portion between the arm-forming assemblies of the tongs device, the extension-forming portion of the bag being folded back around said cross-members to extend substantially over an entire length of the arm-forming assemblies of the tongs device.

2. A pick-up device according to claim 1, wherein inside surfaces of the facing walls of said bag are provided with an adhesive.

3. A pick-up device according to claim 2, wherein the control extensions of said arm-forming assemblies include respective substantially planar parts onto which the free ends of the extension-forming portions of said bag can be affixed.

4. A pick-up device according to claim 1, wherein the bag is comprised of polyethylene.

5. A pick-up device according to claim 1, wherein said lip portions come into mutual contact under the effect of said resilient return means.

6. A device for picking up litter such as animal excrement comprising:

a tongs device including two substantially identical arm-forming assemblies, each one of said arm-forming assemblies comprising two elongated elements having first and second ends, interconnection means for interconnecting said first ends of the elongated elements, and a cross-member for interconnecting said second ends of said elongated elements, said interconnection means being disposed along an axis parallel to said cross-members so that said arm-forming assemblies are pivotally mounted about said axis, two control extensions extending beyond said axis, each said control extension being integral with a corresponding one of said arm-forming assemblies and being disposed at an angle relative to the corresponding arm-forming assembly, and resilient return means cooperating with said control extensions for pressing said cross-members together; and a bag suitable for mounting on the tongs device and comprising a pocket-forming portion including two facing walls interconnected at bottom edges thereof and two bellows-forming parts interconnecting side edges of said walls, and two extensions, each said extension extending beyond an upper edge of each of said facing walls and having a free end, said pocket-forming portion being selectively disposed between the arm-forming assemblies of the tongs device with each of said extensions of the bag being folded back around an associated one of said cross-members and extending substantially over an entire length of the arm-forming assemblies of the tongs device.

7. A pick-up device according to claim 6, wherein each said extension of the bag comprises a width that tapers from a maximum extent at said upper edge of said walls toward said free end.

8. A pick-up device according to claim 7, wherein inside surfaces of the walls of said bag are provided with an adhesive.

9. A pick-up device according to claim 6, wherein said walls have inner surfaces provided with an adhesive adjacent each said upper edge.

10. A pick-up device according to claim 6, wherein the bag comprises polyethylene.

11. A pick-up device according to claim 6, wherein each said cross-member includes a lip-forming portion, said lip-forming portions coming into mutual contact under the effect of said resilient return means.

12. A pick-up device according to claim 6, wherein the control extensions of said arm-forming assemblies include respective substantially planar parts onto which the free ends of the extensions of said bag are selectively affixed.

13. A device for picking up litter such as animal excrement comprising:

a tongs device, including two substantially identical arms-forming assemblies, each one of said arms-forming assemblies comprising two elongated elements having first and second ends, interconnection means for interconnecting said first ends of the elongated elements and a cross-member for interconnecting said second ends of said elongated elements, said interconnection means cooperating with an axis disposed parallel to said cross-members so that said arms-forming assemblies are pivotally mounted about said axis, two control extensions extending beyond said axis, each one of said control extensions being integral with a respective one of said arms-forming assemblies and being disposed at an angle relative to the respective arms-forming assembly, and resilient return means cooperating with said control extensions for pressing the cross-members against each other; and a bag suitable for mounting on the tongs device and comprising a pocket-forming portion including two facing walls that are interconnected at a bottom and at two bellows-forming parts, and an extension-forming portion extending from each of the walls of the pocket-forming portion, said pocket-forming portion being selectively disposed between the arms-forming assemblies of the tongs device with the extension-forming portions of the bag folded back around respective ones of said cross-members and said extension-forming portions extending substantially over an entire length of the arms-forming assemblies of the tongs device, whereby said extension-forming portions cling to at least one of said cross-members and said elongated elements.

14. A pick-up device according to claim 13, wherein the bag is comprised of polyethylene.

15. A pick-up device according to claim 13, wherein each one of said cross-members includes a lip-forming portion, said lip-forming portions coming into mutual contact under the effect of said resilient return means.

16. A pick-up device according to claim 13, wherein the bag is comprised of a plastics material whereby said extension-forming portions continue to cling upon exertion of a traction force on a portion of said bag.

17. A pick-up device according to claim 13, wherein an open end of the bag opposite from said bottom is provided with respective closure handles extending beyond said extension-forming portions.

* * * * *